US009192268B2

(12) United States Patent
Denis et al.

(10) Patent No.: US 9,192,268 B2
(45) Date of Patent: Nov. 24, 2015

(54) DISPENSER FOR PAPER IN ROLL FORM, HAVING A BASE UNIT AND AT LEAST A FIRST DOOR AND A SECOND DOOR INSTALLED ON THE BASE UNIT OF THE DISPENSER

(75) Inventors: Yoann Denis, Selestat (FR); Nicolas Pommier, Colmar (FR); Julien Marietta-Tondin, Marckolsheim (FR); Jean-Louis Jehl, Artolsheim (FR)

(73) Assignee: SCA TISSUE FRANCE, Saint-Ouen (FR)

( * ) Notice: Subject to any disclaimer, the term of this patent is extended or adjusted under 35 U.S.C. 154(b) by 734 days.

(21) Appl. No.: 13/264,305

(22) PCT Filed: Jun. 9, 2011

(86) PCT No.: PCT/FR2011/000338

§ 371 (c)(1), (2), (4) Date: Oct. 13, 2011

(87) PCT Pub. No.: WO2011/154625

PCT Pub. Date: Dec. 15, 2011

(65) Prior Publication Data

US 2012/0175455 A1 Jul. 12, 2012

(30) Foreign Application Priority Data

Jun. 10, 2010 (EP) ..... 10305621

(51) Int. Cl.
*A47K 10/32* (2006.01)
*A47K 10/38* (2006.01)

(52) U.S. Cl.
CPC ..... *A47K 10/3818* (2013.01); *A47K 2010/3233* (2013.01); *A47K 2010/3253* (2013.01)

(58) Field of Classification Search
CPC ..... A47K 10/32; A47K 10/34; A47K 10/38; A47K 10/3818; A47K 2010/3233; A47K 2010/3818; A47K 2010/3827; A47K 2010/3253; B65H 49/02; B65H 49/04; B65H 49/10
USPC ..... 242/593, 594, 594.1, 594.5, 594.6, 560
See application file for complete search history.

(56) References Cited

U.S. PATENT DOCUMENTS 3,132,782 A 5/1964 Coates, Jr.
5,065,924 A * 11/1991 Granger ..... 225/46

(Continued)

FOREIGN PATENT DOCUMENTS

GB 2269361 A 2/1994
WO WO-2010076575 7/2010

OTHER PUBLICATIONS

English translation of the Written Opinion of the International Searching Authority that issued in PCT/FR2011/000338 on Sep. 6, 2011.

(Continued)

*Primary Examiner* — Sang Kim
*Assistant Examiner* — Nathaniel Adams
(74) *Attorney, Agent, or Firm* — Drinker Biddle & Reath LLP

(57) ABSTRACT

A dispenser for paper, in particular absorbent paper, having a case in which at least two rolls of a paper web are housed. The case includes a base unit having at least a first housing and a second housing for holding respectively at least first and second rolls, and at least a first door and a second door installed on the base unit. The doors are designed, in the closed position, to respectively protect the first and second rolls and, in the open position, to provide access respectively to the first and second housings in order to reload them individually with rolls. The first and second doors have respectively a first and a second nozzle for dispensing the webs from the first and second rolls.

14 Claims, 5 Drawing Sheets

(56) References Cited

U.S. PATENT DOCUMENTS

| | | | | |
|---|---|---|---|---|
| 5,715,971 | A * | 2/1998 | Morand | 221/45 |
| 5,785,274 | A * | 7/1998 | Johnson | 242/593 |
| 6,056,233 | A * | 5/2000 | Von Schenk | 242/594.5 |
| 6,089,499 | A | 7/2000 | Robinson | |
| 6,189,730 | B1 | 2/2001 | McClymonds | |
| 7,293,738 | B2 * | 11/2007 | Grebonval et al. | 242/597.7 |
| 2005/0051568 | A1 * | 3/2005 | Young et al. | 221/34 |
| 2006/0261076 | A1 * | 11/2006 | Anderson | 221/33 |
| 2007/0023563 | A1 | 2/2007 | Hendrix et al. | |
| 2008/0283546 | A1 * | 11/2008 | Neveu et al. | 221/45 |
| 2010/0032445 | A1 * | 2/2010 | Bunoz | 221/45 |

OTHER PUBLICATIONS

PCT International Search Report and Written Opinion for Application No. PCT/FR2011/000338; Filing Date: Jun. 9, 2011; Date of Mailing: Sep. 6, 2011; 2 pgs.

EP Search Report for Application No. 10305621.4; Date of Filing: Jun. 10, 2010; Date of Completion: Nov. 4, 2010; 2 pgs.

* cited by examiner

DISPENSER FOR PAPER IN ROLL FORM, HAVING A BASE UNIT AND AT LEAST A FIRST DOOR AND A SECOND DOOR INSTALLED ON THE BASE UNIT OF THE DISPENSER

The invention relates to a dispenser for paper, in which at least two rolls are housed. The invention is used more particularly in dispensers for absorbent paper, for example dispensers for bathroom tissue and paper wipes.

In public places, in particular, bathroom tissue dispensers generally comprise a case, in which there is installed a roll of a bathroom tissue web which is unwound through a dispensing orifice.

The paper web has pre-cuts transversely to its unreeling direction, defining rectangular sheets that can be detached individually. Bathroom tissue is a tissue paper, flexible and having a soft surface, comprising one or more plies the basis weight of which is usually between around 14 g/cm$^2$ and 30 g/cm$^2$.

The most widespread dispensers comprise an opening, or window, which is at least as wide as the bathroom tissue, located in a low position on the dispenser and through which the paper is unwound. In order to unwind the paper, the free end of the paper which corresponds to the outer layer of the roll is pulled: this is known as peripheral unwinding of the paper.

When the user has a certain quantity of paper, he can cut it using, for example, a cutting edge of the dispenser opening. For the operator of a paper dispenser, and consequently for its designer, one of the main issues in defining the features of the dispenser and its roll is to minimize the consumption of paper. The drawback with the device described above is the freedom the paper user has to unwind a large number of sheets of paper by pulling on the end of the web in a continuous manner. This capability on the part of the user translates statistically into a considerable waste of paper, since the user unwinds more paper than he needs.

One solution consists in imposing sheet-by-sheet unwinding of the paper on the user. In the field of kitchen paper or paper wipes, i.e. paper which is thicker and more water-resistant than bathroom tissue and the sheets of which are larger and also less flexible and less soft than those of bathroom tissue, the prior art proposes centrally unwinding sheet-by-sheet dispensers.

In the latter, the paper is unwound from the centre of the roll and extracted through the orifice in a nozzle which is positioned in the axis of the roll or at the periphery of the dispenser, the nozzle generally having a frustoconical form with a small output section in order to impose sheet-by-sheet dispensing. This is known as central unwinding of the paper, in this case sheet-by-sheet. An example of a dispenser of this kind is described in the document FR 2,761,252.

French Patent Application FR 04/51748 of Georgia Pacific France discloses a sheet-by-sheet bathroom tissue dispenser, having a dispensing nozzle which delivers sheets of paper in barely crumpled form at the outlet of the nozzle, this making them more user-friendly, while furthermore ensuring minimal consumption of paper.

Such a centrally unwinding dispenser has a particular storage capacity. Once this capacity has been exhausted, paper is no longer available. The result of this is that toilet users have to find an operational dispenser where paper is still available. There is a need to increase the availability of paper and to provide a dispenser that is always operational.

The obvious solution of increasing the size of the rolls is not satisfactory. This is because, if, during the verification of the amount of paper available, it transpires that there is relatively little left, it is possible to replace the partially empty roll with a new roll, this resulting in a waste, or it is possible not to replace it and to wait until it is finished, this possibly resulting in a shortage if the roll is not changed in a timely manner.

In other words, a large-capacity roll limits the number of reloading operations but does not limit the risk of shortage and does not increase the availability of the paper.

Another obvious solution would be to provide a plurality of dispensers next to one another so as to make it possible to have a large amount of paper so as to avoid a shortage while avoiding waste.

In practice, this solution has a high cost. Doubling the number of dispensers does not afford any savings. In addition, the paper dispensers are generally provided in toilets having small dimensions. Increasing the number of dispensers reduces the space allotted to users in the toilets.

Another problem encountered in the laying out of toilets is the positioning of a dispenser which is larger in one direction than in another direction.

In order not to collide with the door of the toilets or the ramp provided in toilets for the disabled, it proves expedient to be able to position the largest dimension of the dispenser horizontally, vertically or in an inclined manner, depending on the organization of the space in the facilities.

To this end, the invention relates to a dispenser for paper in roll form, in particular absorbent paper, comprising a case in which at least two rolls of a paper web are housed, the case having:

- a base unit having at least a first housing and a second housing for holding respectively the at least first and second rolls, and
- at least a first door and a second door, said doors being installed on the base unit and being designed, in the closed position, to protect respectively the first and second rolls and, in the open position, to provide access respectively to the first and second housings in order to reload them individually with rolls, the first and second doors having respectively a first and a second nozzle for dispensing the webs from the first and second rolls.

The dispenser according to the invention is advantageously continuously operational by making paper always available, one of the rolls being used as a spare roll. By virtue of the individual doors, the reloading of each of the housings of the dispenser is independent. This makes it possible in an advantageous manner not to interfere with the dispensing of a roll which is not completely empty while the other roll is being reloaded. In addition, this avoids contamination of the partially used roll.

Furthermore, while the doors are being closed, it is necessary to pull on the end of the sheet extracted from the nozzle while closing the door in order that the sheet does not remain between the edge of the roll and the closed door, it being possible for this to cause a jam during unwinding. The dispenser according to the invention enables the maintenance worker to correctly close the door and keep the web of paper positioned correctly with respect to the nozzle. Ergonomic constraints are thus respected for the maintenance worker.

In the case of central unwinding, when the roll is new it has a certain rigidity which allows it to be handled without altering its ability to unwind. Once the roll has been started, its rigidity decreases as it is unwound. If a roll which has partially been started suffers an impact or is displaced, it sags in on itself and can no longer be used, it then being no longer possible to centrally unwind the roll.

Another use of this dispenser makes it possible to provide different kinds of rolls in each of the housings, thereby making it possible to offer a greater variety of papers to users.

The dispenser is advantageously compact and makes it possible to use rolls of bathroom tissue having similar dimensions to those in Patent Application FR 04/51748.

Preferably, the doors are contiguous in the closed position. Thus, no space is formed between the doors, thereby preventing a liquid from reaching the rolls, which are protected by the doors. Furthermore, the contiguous doors form an overall cover with at least two dispensing nozzles.

According to another aspect of the invention, the first and second doors are connected to the base unit by pivoting means which are arranged to space the doors apart from the base unit when they are opened, the doors remaining close together in the closed position.

Preferably, the pivoting means are in the form of an oblique hinge. The term "oblique" is understood as meaning that the respective directions of the hinges are different. Once the dispenser has been mounted on a vertical wall, the hinge advantageously guides the door in an oblique manner with respect to the base unit. While the door is being opened, it is spaced apart from the other door without friction. The same applies during closure when the door is moving towards the base unit and is contiguous with the other door only when completely closed.

Further means may be envisaged for installing the doors, such as means forming a slideway, with opening by translation.

In a preferred manner, each door is in the form of casing comprising:

- an open rear face in order to introduce the roll into the casing when the door is closed,
- a lateral face towards said other door, and
- other faces such that the doors together form a continuous casing when they are in the closed position.

According to another aspect of the invention, the first and second housings comprise respectively a first and a second roll holder, said roll holders being arranged to hold respectively the first and second rolls when the dispenser is in the installed position.

The dispenser can be installed on a vertical surface in a plurality of positions (vertical, horizontal, oblique).

Advantageously, the roll holders keep and hold the rolls in all positions. Attachment means on the rear face of the base unit are provided to this end for easy mounting in all positions. They are for example provided with elongate orifices in order to be suitable for the various positions existing on vertical surfaces.

Preferably, the geometry and/or dimensions of each roll holder is/are designed to laterally cover the roll held thereby so as to protect said roll laterally when a door is open. Thus, when a first housing is being reloaded and its first door is open, the second roll, which does not have to be reloaded and which is protected by its second door, can be accessed through its open lateral face. The second-roll holder advantageously protects the lateral part of the second roll and advantageously replaces a "closed" lateral face of the second door.

Also preferably, the roll holders extend at right angles to the base unit at the periphery of the first and second housings.

Still preferably, the roll holders are in the form of a cylinder or of a portion of a cylinder. The roll holder is hollowed out laterally, and preferably the part that holds the roll forms an angle ($\alpha$) of between 180 and 360°, preferably strictly greater than 180° and less than or equal to 280°.

Advantageously, each door of the dispenser engages with the holders in its housing in order to provide a continuous separating partition when the door of the other housing is open and thus to prevent the second roll being contaminated during the reloading of the first housing.

According to another aspect of the invention, each housing comprises a push plate, elastic means being installed between the housing and the push plate so as to space the plate apart from its housing. Thus, the rolls are forced against the doors, thereby keeping the rolls correctly pressed against the door and thus avoiding sagging in of the rolls.

Preferably, each door comprises locking means arranged to lock the door with respect to the base unit in the closed position.

Finally, according to one embodiment of the invention, the dispenser is a centrally unwinding dispenser.

According to a preferred embodiment of the invention, the dispenser is a dispenser for absorbent paper such as bathroom tissue.

The invention will be better understood with the aid of the following non-limiting description of the preferred embodiment of the dispenser of the invention and with reference to the appended drawing, in which.

Figure 1:
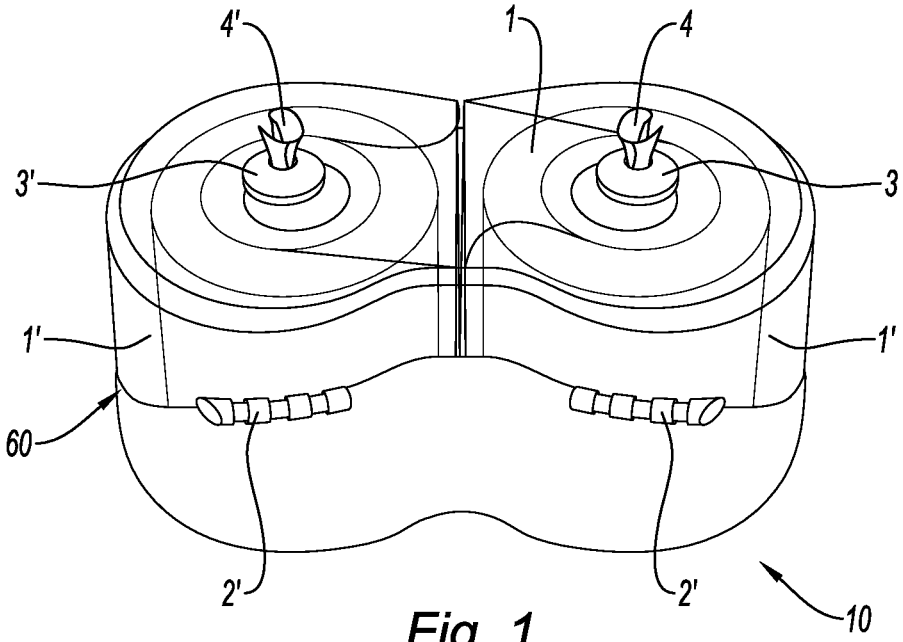
FIG. 1 is a perspective view of a two-housing dispenser according to the invention, a roll of bathroom tissue being housed in each of the housings and a sheet of bathroom tissue being in the process of being unwound from each of the rolls.

With reference to FIG. 1, the dispenser 10 of the invention is a bathroom tissue dispenser.

The bathroom tissue is in this case tissue paper, having for example two plies, or layers, optionally connected together by any appropriate mechanical or chemical means, for example by knurling or adhesive bonding, in a manner well known to a person skilled in the art. The bathroom tissue is in the form of a web which wound on a roll 4, the latter possibly having a central internal core, the core being withdrawn when the roll comes into operation. The web has pre-cuts transversely to the unwinding direction of the web, defining sheets of paper that can be detached individually.

The dispenser 10 comprises a case 60, of elongate form, for accommodating at least two rolls 4, 4', which are cylindrical. The case 60 is designed such that the rolls 4, 4' do not rotate about their axis as they are unwound.

In this example, the case is formed in one piece, forming an overall case. It goes without saying that the case could be formed from at least two individual cases fitted together, for example by means of clips.

With reference to FIGS. 1 to 4, the case 60 has a base unit 5, in which the rolls 4, 4' are housed. The rolls 4, 4' are covered by a cover formed by two doors 1, 1' for individually reloading each of the rolls 4, 4' in the dispenser 10. The term "base unit" is understood to mean either a single base unit or an assembly of a plurality of elementary base units, for example using clips to ultimately form said base unit.

In the following, the terms "left" and "right" are defined with respect to FIG. 4, in which the dispenser 10 is divided by the plane (P), the parts of the dispenser to the left of the plane (P) being denoted "left-hand parts" while those to the right of the plane (P) are denoted "right-hand parts".

The dispenser 10 will now be described in detail.

Dispenser Base Unit (5)

Figure 5:
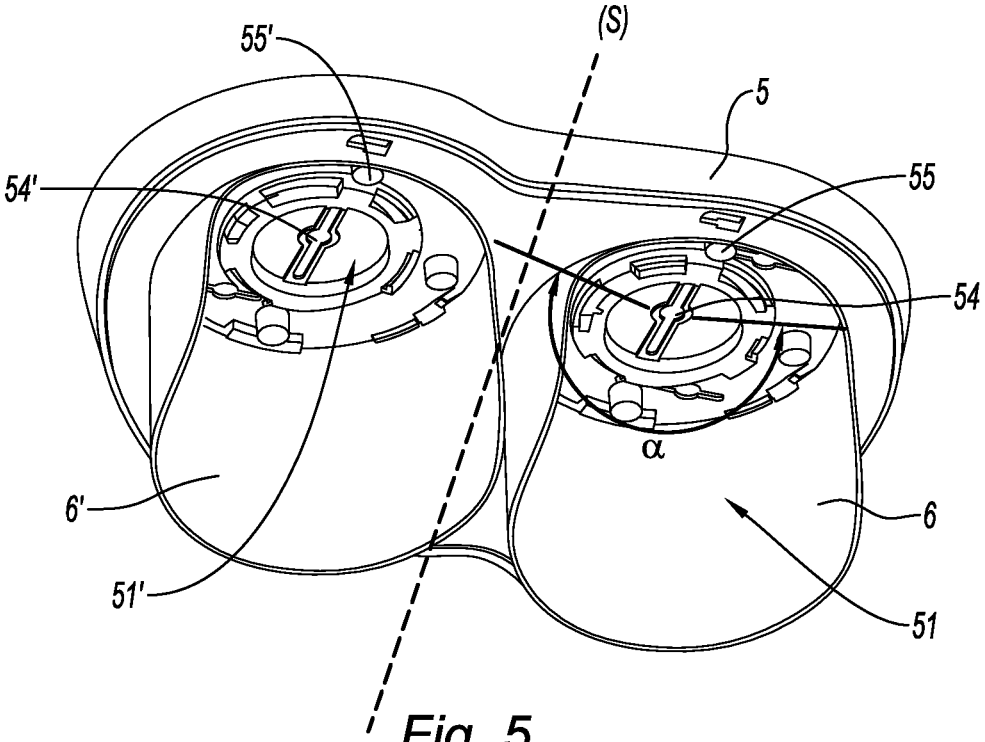
FIG. 5 is a schematic top view of the base unit of the dispenser according to the invention with its roll holders.
Figure 9:
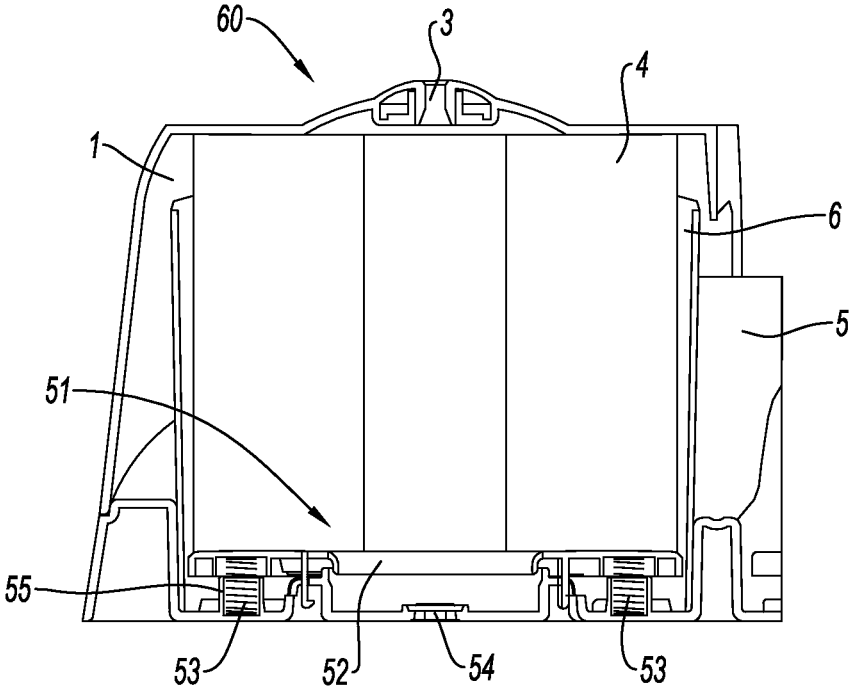
FIG. 9 is a sectional top view (at a slight angle) along the axis Y-Y of the right-hand compartment of the dispenser in FIG. 8.
Figure 10:
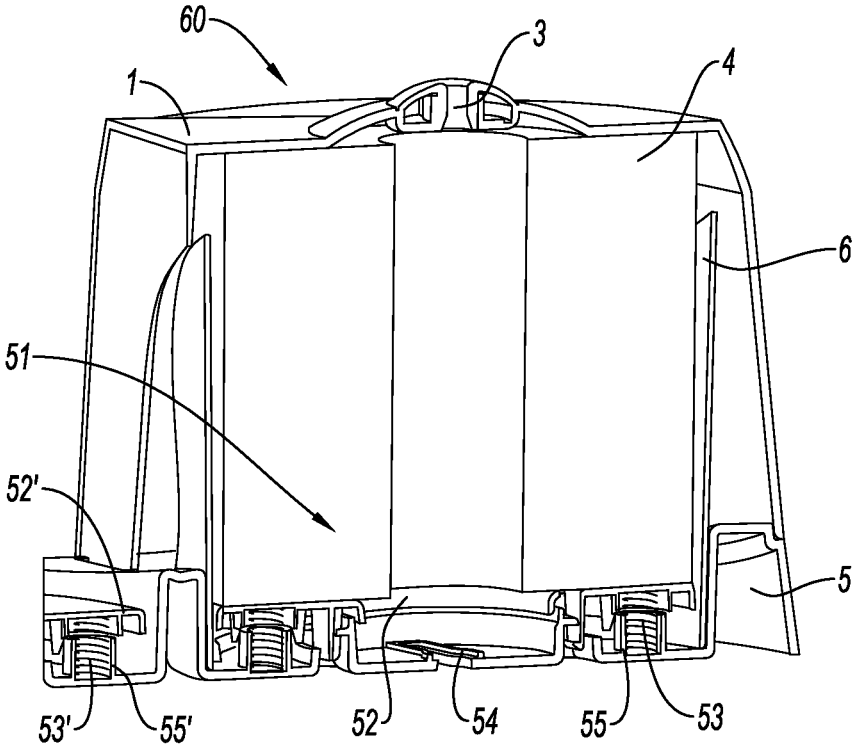
FIG. 10 is a sectional bottom view (at a slight angle) along the axis Y-Y of the right-hand compartment of the dispenser in FIG. 8.

With reference to FIGS. 5, 9 and 10, the base unit 5 is in the form of an elongate element in which two housings 51, 51' for accommodating rolls 4, 4' are provided: one right-hand housing 51 and one left-hand housing 51'.

The housings 51, 51' are formed in the thickness of the base unit. The housings 51, 51' are in this case circular in order to accommodate respectively the tubular rolls of bathroom tissue 4, 4'.

Each housing 51, 51' comprises through-openings 54 which are designed to mount the base unit 5 on a vertical wall. In this example, each housing 51, 51' comprises a plurality of through-openings 54, a central one of which is in the form of a longitudinal slot having a circular opening at its centre. In a known manner, this makes it possible to manually mount the dispenser 10 on a wall in which screws are mounted.

The plurality of openings 54 are designed such that the dispenser 10 can be installed in a horizontal position (if the long dimension of the dispenser is horizontal), in a vertical position (if the long dimension of the dispenser is vertical), and in an oblique position (if the long dimension of the dispenser is oblique).

In the following text, the dispenser 10 is described installed in a horizontal position, but it goes without saying that the dispenser 10 could also be installed in a vertical or oblique position.

Protective Doors (1, 1')

Figure 3:
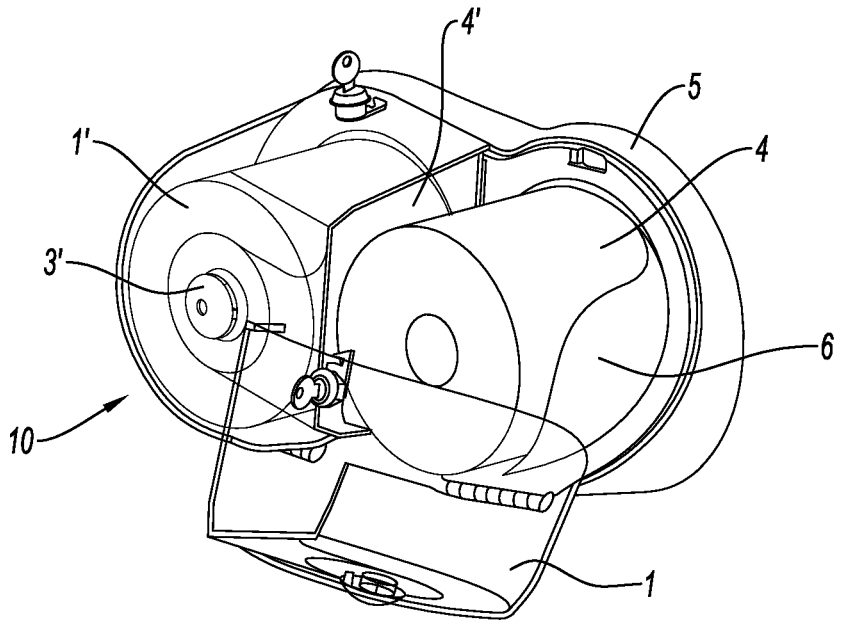
FIG. 3 is a perspective view of the dispenser in FIG. 2, the right-hand compartment of the dispenser being open.
Figure 4:
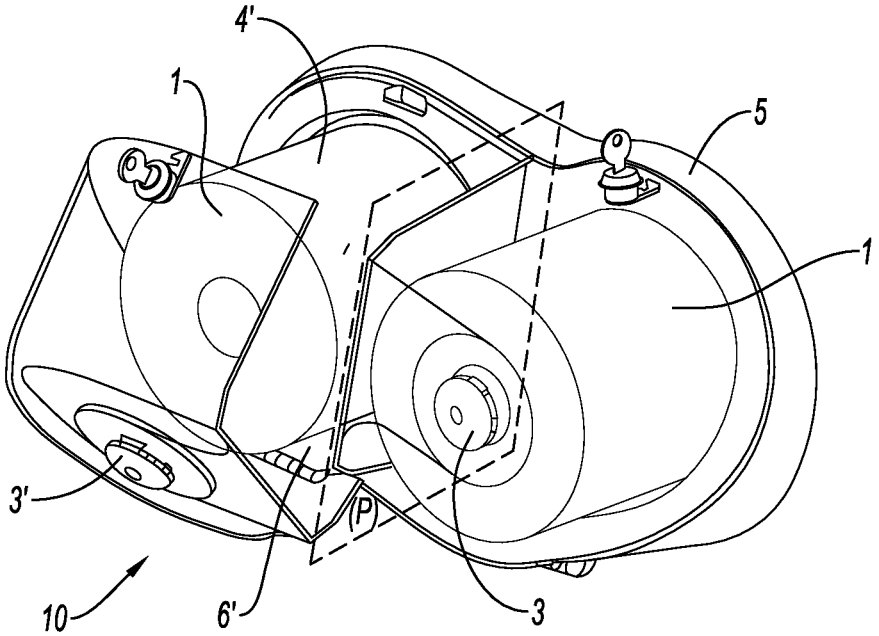
FIG. 4 is a perspective view of the dispenser in FIG. 2, the left-hand compartment of the dispenser being open.

With reference now to FIGS. 3 and 4, the right-hand rolls 4 and the left-hand rolls 4' are respectively protected by a right-hand door 1 and a left-hand door 1', said doors being pivotably mounted with respect to the base unit 5 via a right-hand hinge 2 and a left-hand hinge 2'.

The doors 1, 1' each have a nozzle 3, 3' for dispensing bathroom tissue webs from the rolls 4, 4'.

The bathroom tissue is unwound from the centre of the roll 4, 4' and extracted through the orifice in the nozzle 3, 3'. The nozzle 3, 3' generally has a frustoconical form with a small output section in order to impose sheet-by-sheet dispensing.

In the closed position, the doors 1, 1' protect the rolls 4, 4' from any external attacks so as to ensure that the bathroom tissue remains hygienic. To this end, the doors 1, 1' are contiguous in the closed position, so as to form an overall cover for the dispenser 10. In this example, each door 1, 1' is in the form of a partially cylindrical casing comprising an open rear face for introducing the roll 4, 4' into the casing when the door 1, 1' is closed, a lateral face hollowed out or partially hollowed out towards said other door 1, 1' and other faces such that the doors 1, 1' together have a continuous casing when they are in the closed position. In other words, the association of the two doors 1, 1' in the closed position advantageously fulfils the same function as a single overall cover. In other embodiments, the lateral face may also be solid.

In the open position, the doors 1, 1' enable access to the housings 51, 51' in order to reload them individually with rolls 4, 4'. This makes it possible to individually reload a housing 51, 51' by opening one door 1, 1' while leaving the other door 1, 1' in the closed position so that it protects the roll 4, 4' being used.

Figure 2:
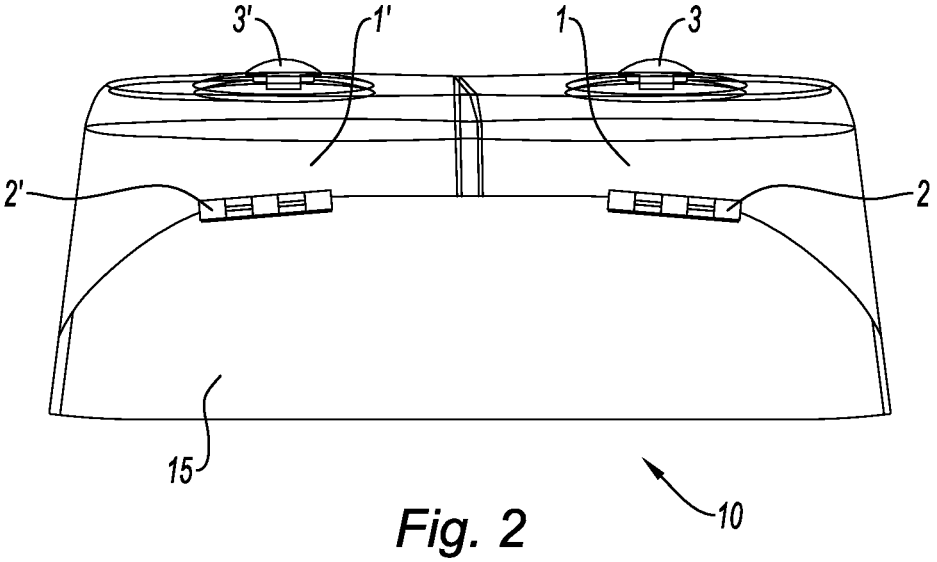
FIG. 2 is a schematic bottom view of the dispenser in FIG. 1 installed in a horizontal position.
Figure 6:
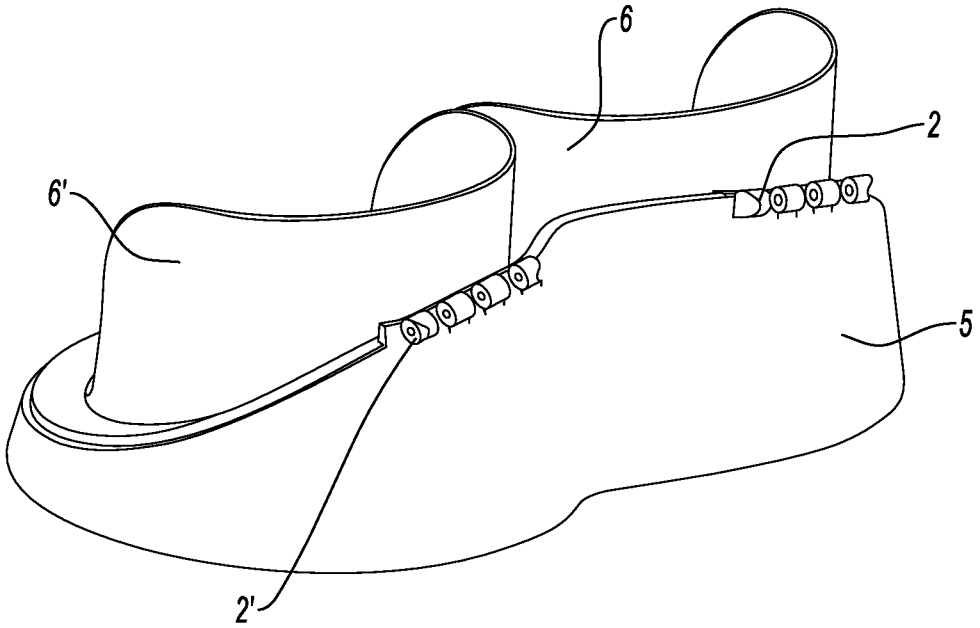
FIG. 6 is a schematic bottom view of the base unit of the dispenser in FIG. 5.

In this example, with reference to FIGS. 2 and 6, the hinges 2, 2' are oblique hinges; i.e. the direction of the axis of the right-hand hinge 2 is different from the direction of the axis of the left-hand hinge 2'. In addition, the axes of the hinges 2, 2' do not extend respectively parallel to the direction in which the dispenser 10 extends. This advantageously makes it possible to pivot the door 1, 1' in an oblique manner with respect to the base unit 5.

In other words, still for a dispenser 10 installed horizontally, when a door 1, 1' is opened, it moves in an oblique direction which comprises a vertical component but also a horizontal component in order that it is spaced apart from the centre of the dispenser 10, i.e. from a plane (P) which corresponds to the lateral faces of the doors 1, 1'. In other words, between its closed position and its open position, the door 1, 1' is spaced apart from the plane (P), thereby making it possible to avoid the doors 1, 1' coming into contact when one of the two doors is opened or closed. Preferably, the hinges 2, 2' are in the lower part of the dispenser 10 such that the doors 1, 1' open essentially in the downward direction.

Figure 7:
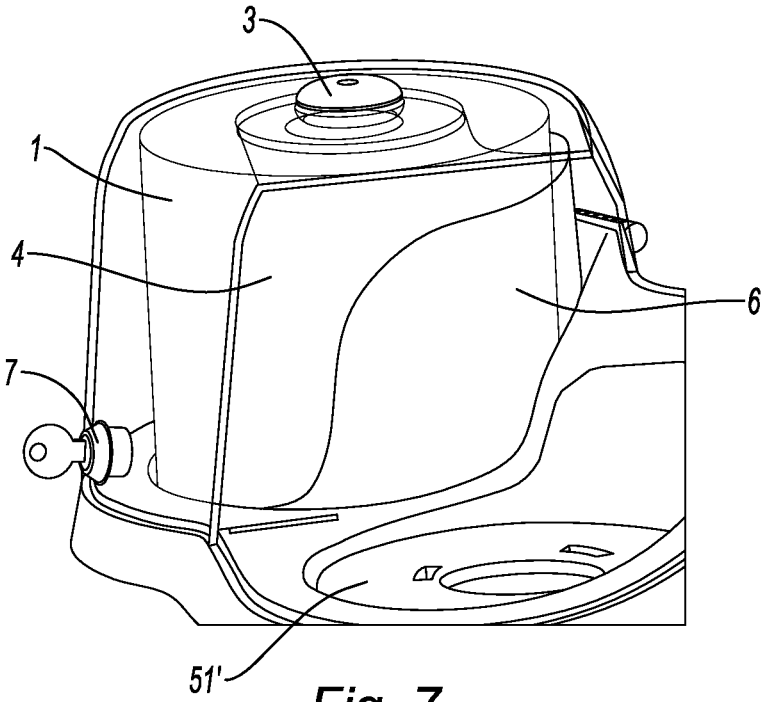
FIG. 7 is a schematic perspective view of the right-hand compartment of the dispenser according to the invention, the left-hand compartment being shown without the roll holder and without the door.
Figure 8:
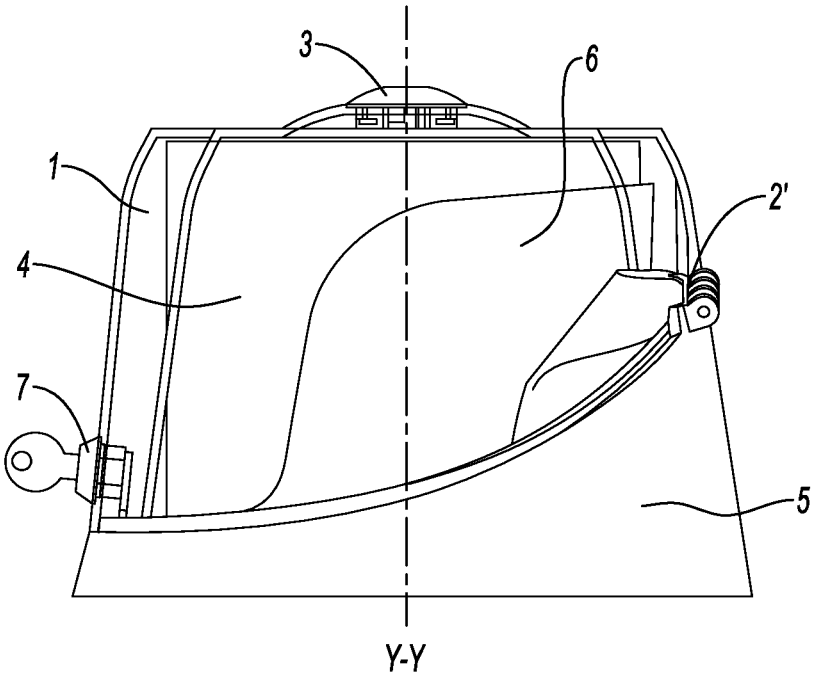
FIG. 8 is a schematic side view of the right-hand compartment of the dispenser in FIG. 7 and comprising an axis Y-Y.

The doors 1, 1' further each comprise means 7, 7' for locking in the closed position, said means 7, 7', with reference to FIGS. 7 and 8, being in the form of a lock closed by a key. This advantageously makes it possible to avoid any theft of the roll of bathroom tissue. The means 7, 7' for locking in the closed position are in this case located in the upper part of the dispenser 10 installed horizontally.

Roll Holders (6, 6')

Still with reference to FIG. 5, for a dispenser 10 installed horizontally, each housing 51, 51' comprises at its periphery a roll holder 6, 6' in the form of a cylindrical tubular portion extending perpendicularly to the base unit 5. The cylindrical tubular portion is hollowed out laterally so as to allow longitudinal and lateral introduction of a roll 4, 4' into a housing 51, 51', the protruding part of the base unit, which holds the roll, forming an angle $\alpha$ as shown in FIG. 5.

In the horizontal use position, when the dispenser 10 is installed on a vertical wall, the angle $\alpha$ of the holder 6, 6' is oriented upwardly so as to enable easy insertion of the roll 4, 4' downwardly, in a vertical direction. The holder 6, 6' fulfils a holding function for the mass of the roll but also a protective function for the web of the roll 4, 4'. The latter function will be explained below.

In this example, the angle $\alpha$ of the holder 6, 6' is around 240°, but it goes without saying that any angle between 180° and 360° could also be suitable to fulfil this double function. Specifically, with such a degree of opening, the holder 6, 6' still fulfils its function of holding the rolls 4, 4' when the dispenser 10 is in the vertical or oblique position.

With reference now to FIGS. 9 and 10, each housing 51, 51' further comprises a circular push plate 52 intended to hold a roll 4, 4' on its front face. Elastic means, in this case springs 53, are fitted between the rear face of the push plate 52 and the front face of the housing 51 in order to press the roll against the door 1 in the closed position. With reference to FIGS. 5, 9 and 10, each housing 51, 51' comprises vertically projecting tubes 55 on its front face, said tubes 55 being designed to accommodate the springs 53, 53' in their internal volume.

The presence of a plurality of springs 53, 53' in a single housing 51, 51' advantageously makes it possible to balance the forward push exerted by the push plate 52, 52' and thus to allow uniform contact between the roll 4, 4' and its door 1, 1'.

Furthermore, the push plate 52, 52' is retained in its housing 51, 51' by stops that limit the travel of the push plate 52, 52' and thus avoid the push plate 52, 52' becoming separated from its housing 51, 51'.

According to another embodiment, the roll holder may be an integral part of the base unit.

According to yet another embodiment, the holder may be formed from a plurality of bearing zones or surfaces that keep the roll in place and ensure the holding function in all directions. The materials of this holder will be chosen in an appropriate manner to fulfil this function.

A way of employing the invention will now be presented.

Use of the Dispenser

Once mounted on a vertical wall in a horizontal installation position, the rolls 4, 4' extend in their housings 51 at right angles to the base unit 5, the mass of the rolls 4, 4' being held by the holders 6, 6' that extend under the rolls 4, 4'. The holders 6, 6' advantageously form cradles in which the rolls 4, 4' are accommodated.

The rolls 4, 4' are protected by the doors 1, 1' in the closed position, said doors 1, 1' forming an overall cover for the dispenser 10 and protecting said rolls 4, 4' from external attacks (impacts, liquid, etc.). One end of the web of bathroom tissue of each roll 4, 4' protrudes through the dispensing nozzle 3, 3' in each of the doors 1, 1', as shown in FIG. 1. Thus, a user can easily pull the end of the web in order to obtain a sheet of paper.

Besides its compactness, the dispenser 10 has a spare roll 4' or 4 which makes it possible to deal with any shortage and/or to limit the number of reloading operations. Furthermore, the rolls 4, 4' are reloaded independently of one another, thereby making it possible to use up a roll 4, 4' before replacing it, the spare roll 4, 4' allowing the transition.

The web of bathroom tissue may be of different types in each of the housings (normal paper and hypoallergenic paper, for example), thereby enabling greater flexibility of use of the dispenser 10. Preferably, dispensing takes place sheet-by-sheet, thereby reducing the consumption of paper by users.

Furthermore, the doors 1, 1' are locked onto the base unit 5 by locking means 7, 7' so as to avoid any theft of rolls 4, 4'.

Reloading the Dispenser

By way of example, in order to reload the right-hand housing 51 of the dispenser 10, the user responsible for maintenance first of all has to unlock the right-hand door 1 so as to allow the right-hand door 1 to pivot with respect to the base unit 5.

Following its opening, the right-hand door 1 moves obliquely downwards in order to come to a standstill under the dispenser 10 as shown in FIG. 3. Once it is open, the right-hand door 1 is in a stable position under the dispenser, the right-hand housing 51 then being accessible for reloading.

Although the right-hand holder 6 is not shown in FIG. 3, a new roll 4 is arranged in the right-hand holder 6 of the dispenser 10, the rear end of the right-hand roll 4 bearing against the right-hand plate 52 of the right-hand housing 51. Once the end of the web of the roll 4 has been passed into the dispensing nozzle 3, the right-hand door 1 is closed again by pivoting it in the opposite direction and at the same time the web of paper extracted through the orifice in the nozzle 3 is pulled. The closing of the right-hand door 1 causes pressure on the right-hand roll 4. In the closed position of the right-hand door 1, the right-hand roll 4 is held firmly between the right-hand door 1 and the right-hand plate 52, thereby avoiding any sagging in of the right-hand roll 4.

With reference to FIGS. 7 and 8, it is noted that reloading of the dispenser 10 is particularly hygienic. This is because, although the right-hand door 1 is hollowed out laterally in the closed position, the left-hand holder 6 associated with the side wall of the right-hand door 1 laterally protects the right-hand roll 4 during the reloading of the left-hand roll 4'.

In other words, the angle $\alpha$ of the holder 6, 6' is advantageously calibrated to allow easy introduction of a new roll (need for a small angle) and also effective holding and protection of the started roll when a new roll is inserted (need for a large angle).

The invention has been presented here with a dispenser comprising two rolls, but it goes without saying that the dispenser could comprise more than two rolls aligned or in staggered rows in the dispenser.

The invention claimed is:

1. A dispenser for paper comprising:

a case configured to house a first roll and a second roll, the case having:

a base unit having at least a first housing and a second housing for holding the first roll and the second roll, respectively, the first and the second housings include a first roll holder and a second roll holder, respectively, said first roll holder arranged to hold the first roll in an installed position, said second roll holder arranged to hold the second roll in an installed position, and at least a first door and a second door, the first and second doors being installed on the base unit and being configured, in a closed position, to protect the first and second rolls, respectively, and, in an open position, to provide access to the first and second housings, respectively, in order to reload the first and the second rolls, respectively, the first and second doors having a first and a second nozzle, respectively, for dispensing paper webs from the first and second rolls, respectively, wherein the first roll holder including a first wall circumferentially extending around an area where the first roll is to be housed, the first wall having an irregular height in an axial direction of the first roll such that a first opening is formed that allows placing the first roll into the first roll holder when the first door is in the open position, the second roll holder including a second wall circumferentially extending around an area where the second roll is to be housed, the second wall having an irregular height in an axial direction of the second roll such that a second opening is formed that allows placing the second roll into the second roll holder when the second door is in the open position, the first and second walls that form the first and the second roll holder, respectively, each have a cylindrical shape, and a diameter of the cylindrical shape is smaller than an inner diameter of the first and second doors, such that an empty circular space is formed between the walls and the respective first and second doors in the closed position, and each of the first and second doors are connected to the base unit by first and second pivoting devices, respectively, arranged to space the first and second doors apart from one another when the first and second doors are opened, the first and the second pivoting devices having first and second pivoting axes that are oblique to each other.

2. The dispenser according to claim 1, wherein the first and second doors are contiguous in the closed position.

3. The dispenser according to claim 1, wherein the first door further includes:

a first open rear face to introduce the first roll into the case when the first door is in the open position, and a first lateral face that is open towards the second door, and the second door further includes, a second open rear face to introduce the second roll into the case when the second door is in the open position, and a second lateral face that is open towards the first door, and the first and second lateral faces are arranged such that the first and second doors together form a continuous front enclosure for the case when the first and second doors are in the closed position.

4. The dispenser according to claim 3, wherein the first and second walls, respectively, are arranged in the closed position such that a first and second line that delineates the first and second lateral faces, respectively, both lie within a plane that is formed substantially between the respective axes of the first and second rolls.

5. The dispenser according to claim 1, wherein at least one of geometry and dimensions of the first and second roll holder is configured to laterally cover the first and second roll so as to protect the first and second roll laterally when the first and second doors are open.

6. The dispenser according to claim 1, wherein the first and second roll holders extend at right angles to the base unit at a periphery of the respective first and second housings.

7. The dispenser according to claim 1, wherein the first and second roll holders are in the form of a portion of a cylinder with an entire section of the cylinder cut-out that forms the first and second opening, respectively.

8. The dispenser according to claim 1, wherein the first door engages with the first roll holder of the first housing in order to provide a continuous separating partition when the second door of the second housing is open.

9. The dispenser according to claim 1, further comprising:

a first and a second push plate, associated with the first and second housing, respectively, wherein elastic means are installed between the respective housing and the respective push plate so as to space the push plate apart from its respective housing.

10. The dispenser according to claim 1, wherein the dispenser is a centrally unwinding dispenser.

11. The dispenser according to claim 1, wherein the circumferential extension of the wall of the first and the second roll holders extend over an angle between 180° and 280° in a circumferential direction.

12. The dispenser according to claim 1, wherein the first and second doors in the closed position are configured to cover the first and second openings in the first and second walls of the first and second roll holders, respectively.

13. The dispenser according to claim 1, further comprising:

an attachment device that is arranged on a rear face of the base unit for attaching the dispenser to a wall.

14. The dispenser according to claim 1, wherein the first wall and the second wall each have a scoop-like shape configured to hold the first and second roll, respectively, by a side wall of the first and second roll, respectively.

* * * * *